United States Patent [19]

Stuever

[11] 4,407,318

[45] Oct. 4, 1983

[54] STICK

[75] Inventor: Joseph H. Stuever, Oklahoma City, Okla.

[73] Assignee: Sierra Survival Company, Inc., Ada, Okla.

[21] Appl. No.: 303,779

[22] Filed: Sep. 21, 1981

[51] Int. Cl.[3] ..... A45B 7/00

[52] U.S. Cl. ..... 135/66; 215/6; 220/4 D

[58] Field of Search ..... 135/65, 66, 69, DIG. 9, 135/46; 138/89, 91, 108, 155; 285/32, DIG. 2; 16/110.5; 215/6; 206/216, 223, 537, 535; 273/68; 220/4 R, 8, 4 B, 4 C, 4 D

[56] References Cited

U.S. PATENT DOCUMENTS

| | | | |
|---|---|---|---|
| 287,170 | 10/1883 | Roovers | 135/65 X |
| 1,252,632 | 1/1918 | Voje | 16/110.5 |
| 1,618,819 | 2/1927 | Emert | 138/177 X |
| 1,806,709 | 5/1931 | Rosinsky | 135/66 |
| 2,326,414 | 8/1943 | Thompson | 215/6 X |
| 2,448,406 | 8/1948 | Allen | 220/8 X |
| 2,532,093 | 11/1950 | Golub et al. | 16/110.5 X |
| 3,327,881 | 6/1967 | Maier | 215/6 |
| 4,351,348 | 9/1982 | Axton | 135/66 |

FOREIGN PATENT DOCUMENTS

| | | | |
|---|---|---|---|
| 381199 | 9/1923 | Fed. Rep. of Germany | 135/66 |
| 2237307 | 2/1974 | Fed. Rep. of Germany | 215/6 |

*Primary Examiner*—Robert A. Hafer
*Assistant Examiner*—Arnold W. Kramer
*Attorney, Agent, or Firm*—Dunlap & Codding

[57] ABSTRACT

An improved stick constructed of multiple section assemblies which are removably interconnectable with connector assemblies. The section assemblies each have storage compartments which are adapted for storing items. Each section assembly includes a section body and a pair of collars, with each collar being connectable to one end of the section body. The connector assemblies each have a storage compartment which is adapted for storing items.

31 Claims, 6 Drawing Figures

STICK

CROSS REFERENCE TO RELATED APPLICATIONS

The present application is related to the patent application entitled SURVIVAL STICK, U.S. Pat. No. 4,351,348, issued Sept. 28, 1982.

BACKGROUND OF THE INVENTION

1. Field of the Invention

The present invention relates generally to improved sticks and, more particularly, but not by way of limitation, to a stick comprised of section assemblies which are removably connectable by connector assemblies, the section assemblies and the connector assemblies each having a storage compartment adapted for storing items.

DESCRIPTION OF THE PREFERRED EMBODIMENT

Figure 1:
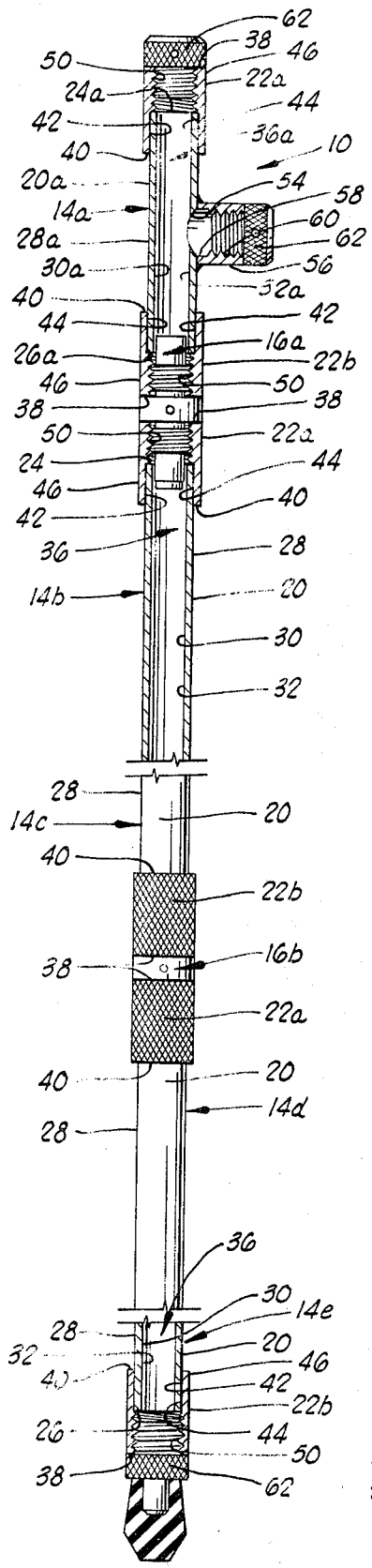
FIG. 1 is a partial sectional view and partial side elevation of an assembled improved stick constructed in accordance with the present invention.

Referring to the drawings in general and to FIG. 1 in particular, shown therein and designated by the reference numeral 10 is an improved stick which is constructed in accordance with the present invention. The stick 10 is constructed by the reversible end-to-end connection of a plurality of section assemblies 14 (five section assemblies being shown in FIG. 1 and designated therein by the reference numerals 14*a*, 14*b*, 14*c*, 14*d* and 14*e*) by means of a plurality of connector assemblies 16 (two connector assemblies being shown in FIG. 1 and designated therein by the reference numerals 16*a* and 16*b*). The assembled stick 10 forms an improved stick to aid in traveling over outdoor terrain (hiking, for example) and other such activities.

Figure 2:
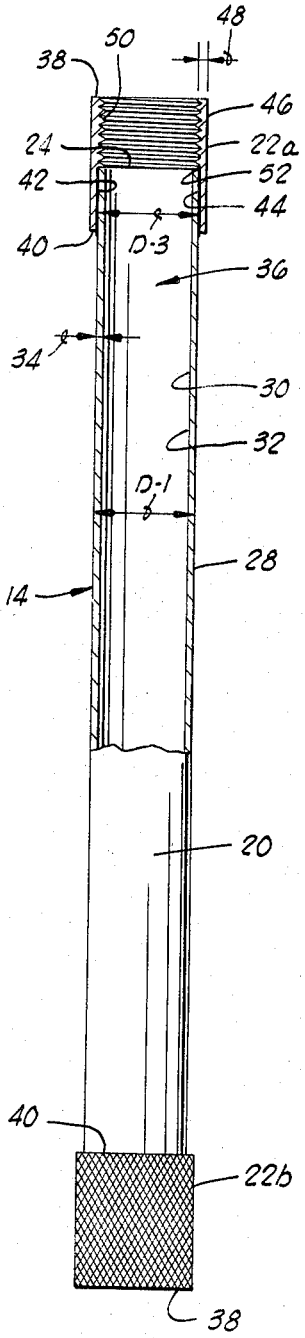
FIG. 2 is a partial sectional view and partial side elevation of a section assembly which is utilized in the stick of FIG. 1.
Figure 3:
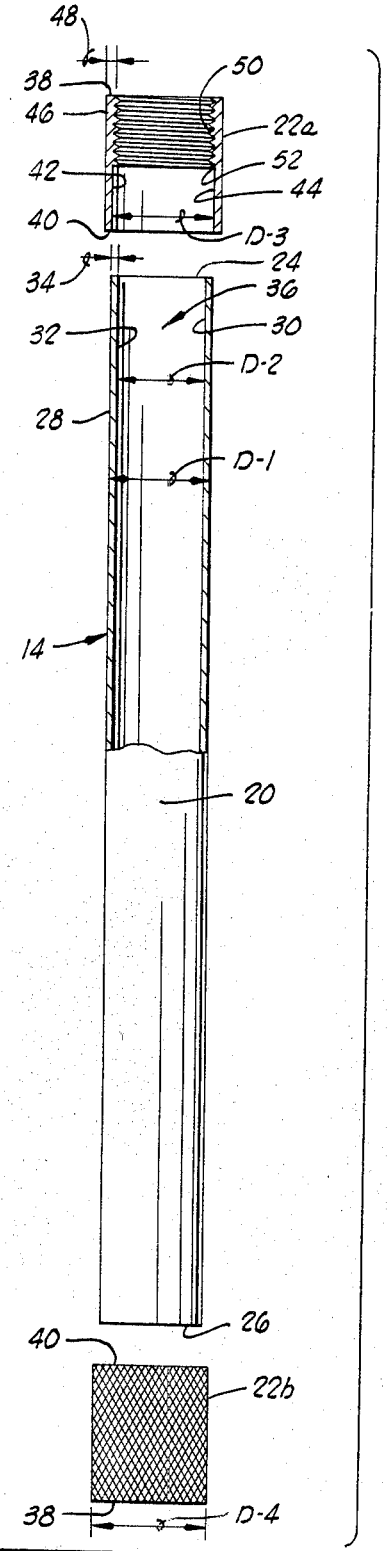
FIG. 3 is a partial sectional view and partial side elevation of a dismantled section assembly.

As shown in FIGS. 1, 2 and 3, each of the section assemblies 14 are identical in construction, except the section assembly 14*a* is slightly different for reasons and in a manner to be described below. It should be noted that the section assembly 14 shown in FIGS. 2 and 3 is typical of the section assemblies 14*b*, 14*c*, 14*d* and 14*e*, the slightly different section assembly 14*a* being shown in FIG. 1.

Each section assembly 14 includes a cylindrically shaped, tubular section body 20 and two collars 22*a* and 22*b*. Each section body 20 has opposite ends 24 and 26 and an outer peripheral surface 28 with an external diameter (D-1). A section body opening 30 extends through each section body 20 intersecting the opposite ends 24 and 26 of the section body 20, each section body opening 30 forming an inner peripheral surface 32 in the section body 20 having an internal diameter (D-2). Each section body 20 has a section body thickness 34 extending between the external diameter (D-1) and the internal diameter (D-2) or, in other words, between the outer and the inner peripheral surfaces 28 and 32. Each section body opening 30 cooperates to form a storage compartment 36 in the section assemblies 14 which is adapted to store items, such as medical supplies, blankets and other such survival-type items, for example.

Each of the collars 22 is identical in construction. Each collar 22 has opposite ends 38 and 40 and a collar opening 42 which extends through the collar 22 intersecting the opposite ends 38 and 40. Each collar opening 42 forms an internal peripheral wall 44 with a diameter (D-3), and each collar 22 has an outer peripheral surface 46 having a diameter (D-4). Each collar 22 has a collar thickness 48, extending generally between the wall 44 and the outer peripheral surface 46 of the collar 22. Each collar 22 has a threaded portion 50 formed on a portion of the internal peripheral annular wall 44 and each threaded portion 50 has an inner peripheral diameter which is slightly smaller than the diameter (D-3) so that each threaded portion 50 provides an abutment wall 52, each threaded portion 50 extending from the end 38 a distance toward the end 40 of the collar 22. In a preferred embodiment, the collars 22 and the section bodies 20 are each constructed of a metal material. The outer peripheral surface 46 of each collar 22 is knurled to enhance the gripability of the collar 22 or, more particularly, to enhance the gripability of the stick 10.

The diameter (D-3) of each collar 22 is slightly greater than the diameter (D-1) formed by the outer peripheral surface 28 of each section body 20. One end portion of each section body 20 is slidingly insertable a distance into the collar opening 42, generally near the end 40 of the collar 22, to a position wherein a portion of the internal peripheral wall 44 of the collar 22 is disposed generally adjacent a portion of the outer peripheral surface 28 of the section body 20, the threaded portion 50 formed in each collar 22 being disposed near the end 38 which is generally opposite the end 40 slidingly receiving one end of one of the section bodies 20. When each end 24 and 26 portion of the section body 20 has been disposed in one of the collars 22, the collars 22 are secured to the section body 20 by such means as an adhesive, for example, to form the completed section assembly 14. The section body thickness 34 is less than the collar thickness 48.

The section body 20 and the collars 22 could be formed from a single piece of tubular material. However, with this unitary type of construction, the single piece of tubular material would have to be sufficiently thick to permit the threaded portions to be formed in the opposite ends. Further, with the unitary type of construction, the threaded portions would have to be formed in each end of the tubular material after the tubular material has been cut to the required lengths of a section assembly. Utilizing the separate collar 22 construction of the present invention, only the collar thickness 48 need be sufficiently thick to accommodate the threaded portions and section body thickness 34 can be substantially less than the collar thickness 48, thereby substantially reducing the weight of each section assembly as compared to the weight of each section assembly utilizing a unitary type of construction, which reduces the weight of the stick 10. In addition, the threaded portion 50 in the separate collars 22 can be formed in a less costly, more efficient manner as compared to the forming of the threaded portions in each end of a section assembly utilizing a unitary type of construction.

In one form, the section body 20 could be inserted into the collar opening 42 to a position wherein one of the ends 24 or 26 abuts the abutment wall 52 formed in the collar 22. In this embodiment, the abutment wall 52 serves to fit the collars 22 on the section body 20 in a proper position to provide the required overall length of the section assembly 14. However, it is believed that other means, such as fixtures, for example, are more desirable for positioning the collars 22 on the section bodies 20.

Figure 4:
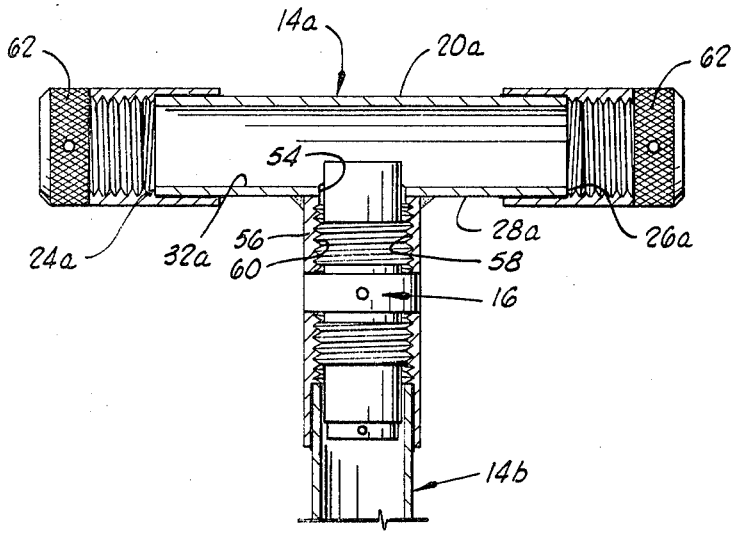
FIG. 4 is a sectional view of a T-shaped section assembly appended through a connector assembly to an end of a straight section assembly to form a crutch-like structure.

As mentioned before, the section assembly 14*a* is slightly different in construction with respect to the construction of the section assemblies 14*b*, 14*c*, 14*d* and 14*e*, it should be noted that section body 20*a* has an opening 54 formed through the outer peripheral surface 28*a* and intersecting the inner peripheral surface 32*a*, the opening 54 being about midway between the opposite ends 24*a* and 26*a* of the section body 20*a*, as shown in FIG. 4. One end of a post 56 is securedly connected to the section body 20*a* generally at the opening 54 and the post 56 extends a distance generally radially outwardly from the section body 20*a*. An opening 58 extends through the post 56 and a threaded portion 60 is formed on the internal peripheral wall formed in the post 56 by the opening 58. The post 56 cooperates in assembling the stick 10 in a crutch-like structure, as will be described below.

The stick 10 also includes a plurality of covers 62. Each cover 62 has a threaded portion and a knurled portion formed on a portion of the outer peripheral surface of the cover 62. The covers 62 cooperate to close the exposed end portions of the stick 10.

Figure 5:
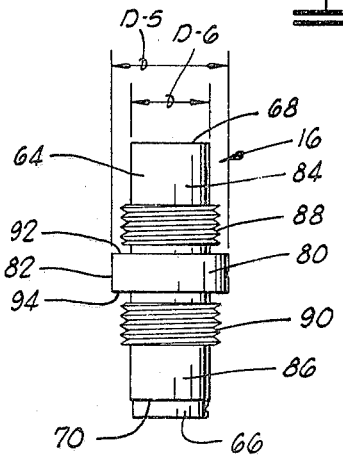
FIG. 5 is a side elevation of a connector assembly which is utilized in the stick of FIG. 1.
Figure 6:
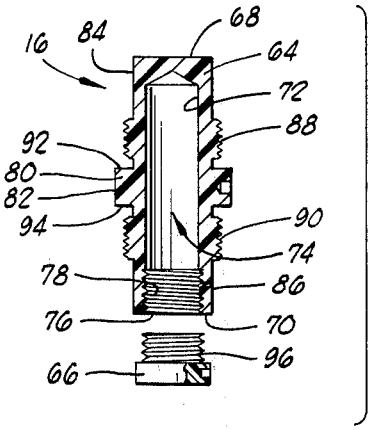
FIG. 6 is a sectional view of a connector assembly body and a side elevation of the detached cap.

The connector assemblies 16 are identical in construction. Each connector assembly 16 includes a connector assembly body 64 and a cap 66, as shown more clearly in FIGS. 5 and 6.

The connector assembly body 64 has opposite ends 68 and 70. A body opening 72 is formed in a portion of the connector assembly body 64, the body opening 72 intersecting the end 70 of the connector assembly body 64 and extending a distance through the connector assembly 64. A portion of the body opening 72 cooperates to form a storage compartment 74 in the connector assembly body 64 which is adapted for storing items, such as various survival type items, for example. The intersection of the body opening 72 with the end 70 forms an access opening 76 in the connector assembly body 64, the access opening 76 providing access to the storage compartment 74 in the connector assembly 64. A portion of the wall formed in the connector assembly body 64 by the body opening 72, generally near the access opening 76 is threaded to form a threaded portion 78.

The connector assembly body 64 generally is cylindrically shaped and has a central region 80, generally midway between the opposite ends 68 and 70, which provides an outer peripheral surface 82. The outer peripheral surface 82 has a diameter (D-5) which is greater than the diameter (D-6) of the portions 84 and 86 of the connector assembly body 64 leading to and including each of the opposite ends 68 and 70 of the connector assembly body 64. The diameter (D-5) is about the same as the diameter (D-4) of the section assemblies 14 or, more particularly, the collar 22.

An externally threaded annular segment 88 is formed on the portions 84 of the connector assembly body 64, having the diameter (D-6) which is smaller than the diameter (D-5) of the central region 80, the threaded segment 88 being disposed generally near the central region 80 and spaced a distance from the end 68. An externally threaded annular segment 90 is formed on the portion 86 of the connector assembly body 64, having the diameter (D-6) which is smaller than the diameter (D-5) of the central region 80, the threaded segment 90 being disposed generally near the central region 80 and spaced a distance from the end 70. The threaded segments 88 and 90 each are sized and adapted to threadingly engage the threaded portion 50 of the section assembly 14 or, more particularly, the collar 22 for connecting the section assemblies in an end-to-end relationship.

The central region 80 of each connector assembly 16 forms a pair of annular walls 92 and 94, the annular wall 92 generally facing and being spaced a distance from the end 68 of the connector assembly body 64 and the annular wall 94 generally facing and being spaced a distance from the opposite end 70 of the connector assembly body 64. In an assembled position, one end of one of the section assemblies 14 abuts the annular wall 92 and one end of another one of the section assemblies 14 abuts the opposite annular wall 94.

The cap 66 has a threaded portion 96. The threaded portion 96 is sized and adapted to threadingly engage the threaded portion 78 formed in the connector assembly body 64. Thus, the cap 66 is threadedly connectable to the connector assembly body 64 to close the access opening 76, thereby enclosing the storage compartment 74, and the cap 66 is removable from the connector assembly body 64 to provide access to the storage compartment 74 via the access opening 76.

In a preferred form, the connector assembly 16 is constructed of a plastic material to inhibit binding between the section assemblies 14 and the connector assemblies 16 in a connected position of the connector assemblies 16 and the section assemblies 14.

Each connector assembly 16 is utilized to connect two section assemblies 14 in an end-to-end relationship. The portion 84 is inserted in one end of one of the section assemblies 14 to a position wherein the threaded segment 88 threadedly engages the threaded portion 50 of the collar 22 portion of the section assembly 14, and the portion 86 is inserted in one end of another section assembly 14 to a position wherein the threaded segment 90 threadedly engages the threaded portion 50 of the collar 22 portion of the other section assembly 14. In a connected position, the annular wall 92 abuts the end 38 of one of the collar 22 portions of one of the section assemblies 14 and the annular wall 94 abuts the end 38 of one of the collar 22 portions of another section assembly 14.

Changes may be made in the construction and the operation of the various components, elements and assemblies described herein without departing from the spirit and the scope of the invention, as defined in the following claims.

What is claimed is:

1. An improved stick comprising:

a plurality of section assemblies having opposite ends, each section assembly comprising:

a section body being cylindrically shaped and having an outer peripheral surface with an external diameter (D-1), opposite ends and a section body opening extending through the section body and intersecting at least one of the ends, a portion of the section body opening forming a storage compartment and the section body opening forming an internal wall having an internal diameter (D-2);

two collars for each section body, each collar being cylindrically shaped and having opposite ends and a collar opening extending through the collar and intersecting the opposite ends, the collar opening forming an internal peripheral annular wall and having an internal diameter (D-3) greater than the external diameter (D-1) of the section body, one end of each section body being insertable a distance into the collar opening in one of the collars and the opposite end of each section body being insertable a distance into the collar opening in one of the other collars in a connected position of the collars and the section body; and a plurality of connector assemblies for removably connecting one end of one section assembly to one end of another section assembly, each connector assembly comprising:

a connector assembly body having opposite ends, an internal storage compartment formed in a portion thereof and adapted for storing items and an access opening formed in a portion of the connector assembly body providing access to the storage compartment, one end of the connector assembly body being removably connectable to one end of one of the section assemblies and the opposite end of the connector assembly body being removably connectable to one end of another section assembly for removably connecting the section assemblies in an end-to-end relationship in a connected position of the connector assembly and the section assemblies; and a cap removably connectable to the connector assembly body generally near the access opening, the cap being shaped to close the access opening in the connected position of the cap to the body.

2. The improved stick of claim 1 wherein each collar is defined further as having a threaded portion formed on the internal peripheral annular wall formed by the collar opening, generally near the end of the collar opposite the end of the collar insertably receiving one end of one of the section bodies.

3. The improved stick of claim 2 wherein the threaded portion in each collar forms an abutment wall in the collar, the end of the section body abutting the abutment wall in the collar in a connected position of the section body and the collar.

4. The improved stick of claim 1 wherein each collar is defined further as having an outer peripheral surface and a collar thickness, generally between the wall formed in each collar by the collar opening and the outer peripheral surface of the collar, and wherein each section body is defined further as having a section body thickness, generally between the outer peripheral surface of the section body and wall formed in each section body by the section body opening, the section body thickness being less than the collar thickness for reducing the weight of the stick.

5. The improved stick of claim 4 wherein each collar is further defined as having a knurled outer peripheral surface for enhancing the gripability of the collar.

6. The improved stock of claim 1 wherein the means for connecting the two collars to the section body is defined further as being as adhesive material.

7. The improved stick of claim 1 wherein the connector assembly body is further defined as being generally cylindrically shaped and having a central region with an external diameter (D-5), the portions of the connector assembly body leading from the central region to and including each of the opposite ends of the connector assembly body having an external diameter (D-6), the diameter (D-5) being greater than the diameter (D-6).

8. The improved stick of claim 7 wherein each collar is defined further as having an annular external peripheral surface having a diameter (D-4), the diameter (D-4) being about the same as the diameter (D-5).

9. The improved stick of claim 7 wherein the connector assembly body is further defined as having an externally threaded annular segment formed generally on each end portion having the diameter (D-6) smaller than the central region diameter (D-5), and wherein each collar is defined further as having a threaded annular segment formed on a portion of the internal wall, one of the smaller diameter end portions of the connector assembly body being insertable into the collar opening of one of the collars connected to one of the section bodies and the opposite smaller diameter end portion of the connector assembly body being insertable into the collar opening of one of the collars connected to one of the other section bodies and the threaded annular segments formed on the internal wall of each collar threadedly engaging the threaded annular segments formed on one of the smaller diameter end portions of the connector assembly body to connect the section assemblies in an end-to-end relationship.

10. The improved stick of claim 7 wherein the central region of the connector assembly body is defined further as cooperating with each of the smaller diameter end portions of the connector assembly body to form a pair of annular walls, each annular wall facing one end of the body and being spaced a distance from one end of the body, one end of one of the section assemblies abutting one of the annular walls on the connector assembly body and one end of another section assembly abutting the other annular wall on the connector assembly in a connected position of the connector assembly and the section assemblies.

11. The improved stick of claim 1 wherein the connector assembly body is further defined as having a body opening inersecting one end of the connector assembly body and extending a distance through the connector assembly body, the access opening being formed by the intersection of the body opening and one end of the connector assembly body and a portion of the body opening extending through the connector assembly body forming the storage compartment with a terminal end wall, the body opening forming an annular wall in the connector assembly body.

12. The improved stick of claim 11 wherein the surface of the annular wall formed by the body opening in the connector assembly body generally near the access opening is further defined as being threaded, and wherein the cap is further defined as having a threaded portion, the threaded portion of the cap being threadedly engageable with the threaded portion in the connector assembly body generally near the access opening.

13. The improved stick of claim 1 wherein each section body is further defined to include a body opening extending through the section body and intersecting the opposite ends of the section body, a portion of the body opening being adapted for storing items.

14. The improved stick of claim 1 wherein each section assembly is defined further as being constructed of a metal, and wherein the connector assembly body is defined further as being constructed of a plastic material to substantially inhibit the section assemblies from binding to the connector assembly body of the connector assembly in a connected position of the section assembly and the connector assembly.

15. A plurality of connector assemblies, each connector assembly having one portion removably connectable to one end of one section assembly and another portion removably connectable to one end of one other section assembly for connecting the section assemblies in an end-to-end relationship in a connected position of the connector assembly and the section assemblies, comprising:

a plurality of connector assembly bodies, each connector assembly body having opposite ends, an internal storage compartment formed in a portion thereof and adapted for storing items and an access opening formed in a portion of the connector assembly body providing access to the storage compartment, one end of the connector assembly body being removably connectable to one end of one of the section assemblies and the opposite end of the connector assembly body being removably connectable to one end of another section assembly to connect the section assemblies in an end-to-end relationship in a connected position of the connector assembly and the section assemblies, the connector assembly bodies connecting a plurality of section assemblies in an end-to-end relationship; and a plurality of caps, each cap removably connectable to one of the connector assembly bodies generally near the access opening, the cap being shaped to close the access opening in the connected position of the cap to the connector assembly body.

16. The connector assembly of claim 15 wherein the connector assembly body is defined further as being cylindrically shaped and having a central region with a diameter greater than the diameter of the portions of the connector assembly body leading to and including each of the opposite ends of the connector assembly body.

17. The connector assembly of claim 16 wherein each section assembly is defined further as having an annular external surface having a diameter and wherein the diameter of the central region of the connector assembly body is defined further as being about the same as the diameter of the annular external surface of each section assembly.

18. The connector assembly of claim 16 wherein the connector assembly body is further defined as having an externally threaded annular segment formed generally on each portion having the diameter smaller than the central region diameter, and wherein each section assembly is further defined as having a threaded portion formed in each of the ends of the section assembly, one of the smaller diameter end portions of the connector assembly body being insertable into the threaded portion formed in one of the section assemblies and the opposite smaller diameter connector assembly end portion of the connector assembly body being insertable into the threaded portion formed in one end of one of the other section assemblies, the threaded portions of each section assembly threadedly engaging the threaded segment formed on one of the smaller diameter end portions of the connector assembly body to connect the section assemblies in an end-to-end relationship.

19. The connector assembly of claim 16 wherein the central region of the connector assembly body is defined further as cooperating with each of the smaller diameter end portions of the connector assembly body to form a pair of annular walls, each annular wall facing one end of the connector assembly body and being spaced a distance from one end of the connector assembly body, one end of each section assembly abutting one of the annular walls on the connector assembly body in a connected position of the connector assembly and the section assembly.

20. The connector assembly of claim 15 wherein the connector assembly body is further defined as having a body opening intersecting one end of the connector assembly body and extending a distance through the connector assembly body, the access opening being formed by the intersection of the body opening and one end of the connector assembly body and a portion of the body opening extending through the connector assembly body forming the storage compartment.

21. The connector assembly of claim 20 wherein a portion of the wall formed by the body opening in the connector assembly body generally near the access opening is further defined as being threaded, and wherein the cap is further defined as having a threaded portion, the threaded portion of the cap being threadedly engageable with the threaded portion of the connector assembly body generally near the access opening.

22. The connector assembly of claim 15 wherein each section assembly is further defined as including a storage compartment formed in a portion thereof and being adapted for storing items.

23. The connector assembly of claim 15 wherein each section assembly is defined further as being constructed of a metal, and wherein the body of the connector assembly is defined further as being constructed of a plastic material to substantially inhibit the section assemblies from binding to the body of the connector assembly in a connected position of the section assemblies and the connector assembly.

24. A stick comprising:

a plurality of section assemblies, each section assembly having opposite ends and a storage compartment formed in a portion thereof; and a plurality of connector assemblies for removably connecting one end of one section assembly to one end of another section assembly, each connector assembly comprising:

a connector body assembly having opposite ends, an internal storage compartment formed in a portion thereof and adapted for storing items and an access opening formed in a portion of the body providing access to the storage compartment, one end of the connector assembly body being removably connectable to one end of one of the section assemblies and the opposite end of the connector assembly body being removably connectable to one end of another section assembly for removably connecting the section assemblies in an end-to-end relationship in a connected position of the connector assembly and the section assemblies; and a cap removably connectable to the connector assembly body generally near the access opening, the cap being shaped to close the access opening in the connected position of the cap to the connector assembly body.

25. The stick of claim 24 wherein the connector assembly body is further defined as being cylindrically shaped and having a central region with a diameter greater than the diameter of the portions of the body leading to and including each of the opposite ends of the body.

26. The stick of claim 25 wherein each section assembly is defined further as having an annular external surface having a diameter and wherein the diameter of the central region of the connector assembly body is defined further as being about the same as the diameter of the annular external surface of each section assembly.

27. The stick of claim 25 wherein the connector assembly body is further defined as having an externally threaded portion formed generally on each portion having the diameter smaller than the central region diameter, and wherein each section assembly is further defined as having a threaded portion formed in each of the ends of the section assembly, one of the smaller diameter end portions of the connector assembly body being insertable into the threaded portion formed in one end of the section assemblies and the opposite smaller diameter end portion of the connector assembly body being insertable into the threaded portion formed in one end of one of the other section assemblies, the threaded portions of each section assembly threadedly engaging the threaded portion formed on one of the smaller diameter end portions of the connector assembly body to connect the section assemblies in an end-to-end relationship.

28. The stick of claim 25 wherein the central region of the connector assembly body is defined further as cooperating with each of the smaller diameter end portions of the connector assembly body to form a pair of annular walls, each annular wall facing one end of the connector assembly body and being spaced a distance from one end of the connector assembly body, one end of each section assembly abutting one of the annular walls on the connector assembly body in a connected position of the connector assembly and the section assembly.

29. The stick of claim 24 wherein the connector assembly body is further defined as having a body opening intersecting one end of the connector assembly body and extending a distance through the connector assembly body, the access opening being formed by the intersection of the body opening and one end of the connector assembly body and a portion of the body opening extending through the connector body forming the storage compartment.

30. The stick of claim 29 wherein the wall formed by the body opening in the connector assembly body generally near the access opening is further defined as being threaded, and wherein the cap is further defined as having a threaded portion, the threaded portion of the cap being threadedly engageable with the threaded portion in the body generally near the access opening.

31. The stick of claim 24 wherein each section assembly is defined further as being constructed of a metal, and wherein the connector assembly body is defined further as being constructed of a plastic material to substantially inhibit the section assemblies from binding to the connector assembly body in a connected position of the section assemblies and the connector assembly.

* * * * *